US008004405B1

(12) United States Patent
Gal

(10) Patent No.: US 8,004,405 B1
(45) Date of Patent: Aug. 23, 2011

(54) ALARM SYSTEM

(75) Inventor: Gyora Gal, Maitar (IL)

(73) Assignee: Nuclear Research Center-Negev, Beer-Sheva (IL)

( * ) Notice: Subject to any disclaimer, the term of this patent is extended or adjusted under 35 U.S.C. 154(b) by 436 days.

(21) Appl. No.: 12/269,899

(22) Filed: Nov. 13, 2008

(30) Foreign Application Priority Data

Nov. 15, 2007 (IL) ..... 187394

(51) Int. Cl.
*G08B 13/00* (2006.01)

(52) U.S. Cl. ..... 340/541; 340/556; 340/572.1; 340/561; 702/2; 702/59; 702/69

(58) Field of Classification Search ..... 340/541, 340/561, 564–567; 700/122–126, 228–244, 700/245–264, 302, 303; 701/220, 224, 225, 701/217; 702/2–18, 41–44, 138, 166, 173–175
See application file for complete search history.

(56) References Cited

U.S. PATENT DOCUMENTS

| | | | | |
|---|---|---|---|---|
| 3,375,885 | A * | 4/1968 | Scott et al. | 175/26 |
| 4,397,004 | A * | 8/1983 | Bronislaw | 367/27 |
| 4,527,150 | A * | 7/1985 | Porat | 340/541 |
| 6,778,469 | B1 * | 8/2004 | McDonald | 367/136 |
| 7,055,625 | B1 * | 6/2006 | Myrick et al. | 175/26 |
| 7,126,475 | B2 | 10/2006 | So | |
| 7,184,907 | B2 * | 2/2007 | Chun | 702/69 |
| 7,450,006 | B1 * | 11/2008 | Doyle et al. | 340/541 |
| 2003/0234119 | A1 * | 12/2003 | Ray | 175/27 |

OTHER PUBLICATIONS

Tucker, Robert E.; McKenna, Jason R.; McKenna, Mihan H.; Mattice, Michael S.; "Detecting Underground Penetration Attempts at Secure Facilities"; Engineer: Professional Bulletin for Army Engineers; Jan. 1, 2007; ISSN: 0046-1989.*

Dwain K. Butler "Microgravimetric and gravity gradient techniques for detection of subsurface cavities" *Geophysics*. vol. 49, No. 7 p. 1084-1096 Jul. 1984.

http:/www.wku.eduinews/releases06/may/robot.html.

Liu et al "Mechanical design and modeling of a robot planetary drilling system" Proc of IDETC/CIE 2005. Sep. 2006.

http://www.spacedaily.com/news/mars-driller-00a3.html.

http://mars.jpl.nasa.gov/technology/subsurface/.

Matti et al "The micro rosa2 activity—conclusion and future plans" 7th ESA Workshop on Advanced Space Technologies for Robotics and Automation ASTRA 2002, ESTEC Noordwijk The Netherlands, Nov. 19-21, 2002.

* cited by examiner

*Primary Examiner* — Benjamin C Lee
*Assistant Examiner* — Peter Mehravari
(74) *Attorney, Agent, or Firm* — Mark Friedman

(57) ABSTRACT

It is provided an alarm system for underground boundary intrusion detection, and methods for deployment and operation. The deployment method includes constructing of a computing-and-empowering apparatus, connecting thereof a longitudinally extended power-and-communication cable, connecting addressable junction-units, storing a physical location and an address of each junction-unit in the computing-and-empowering apparatus, connecting each addressable junction-unit to a wired-mole having a wire bundle which initially is contracted there within and measurable physical characteristics, and infiltrating the wired-moles normally into ground to a desired depth. In operation, the sensors frequently measure the physical characteristics of the wired-mole, deliver the measurement of the physical characteristics to the computing-and-empowering apparatus, which stores and analyzes the measurements, comparing past and present measurements. Once it concludes that an underground boundary intrusion might occur, it issues an alarm signal which includes the physical location of the addressable junction units where intrusion presumably has occurred.

20 Claims, 10 Drawing Sheets

ALARM SYSTEM

CROSS-REFERENCE TO RELATED APPLICATIONS

This application claims the benefit of Israeli patent application Ser. No. 187,394 filed Nov. 15, 2007 by the present inventor.

BACKGROUND OF THE INVENTION

1. The Field of Invention

The invention is in the field of alarm systems, electronic fence and more general, in the field of security and defense systems.

2. The Prior Art

An illegal tunneling activity is conducted by terrorists, smugglers, or prisoners under an above-ground fence protecting a facility, a border, or a prison, respectively. The search for counter measures is a continuous effort by border control police departments, prison managements and defense departments all over the world. Butler (Geophysics, 49, 108496, 1984) suggested to use microgravity measurements to located tunnels. However, the needed equipment is expensive and cumbersome and the method is not sensitive enough.

Similarly, a press release by Western Kentucky University at May 18, 2006, reports on a robot which is "an all-terrain vehicle operated via a laptop computer carries a microgravity meter to locate underground voids, sinkholes, caves or, in the case of the US-Mexico border, clandestine tunnels". (http://www.wku.edu/news/release06/may/printer/robot.html)

Robots were proposed in the prior art for deep drilling. Liu et al (Y. Liu, B. Weinberg, C. Mavroidis, "Mechanical design and modeling of a robot planetary drilling system", Proc. of IDETC/CIE 2005) describe a robot for deep drilling in Mars. U.S. Pat. No. 7,055,625 to Myrick and Gorevan, issued Jun. 6, 2006, describes an autonomous subsurface drilling device with an ability to drill both forward and rearward.

Two U.S. patents address finding an intrusion point in a fence. U.S. Pat. No. 7,126,475 to So, issued Oct. 24, 2006 deals with a fence wire buried in a yard. U.S. Pat. No. 7,184,907 to Chun, issued Feb. 27, 2007 describe a monitoring system of a fiber optic cable, attached to a security fence, which determines the length of the fiber optic cable between a monitoring system and an intrusion point.

U.S. Pat. No. 6,778,469 to MacDonald, issued Aug. 17, 2004, describes a harbor fence "comprises a series of spars that protrude above the water surface, that are spaced approximately uniformly and that are connected to an electrical computer with a telemetry subsystem. Each spar contains electronic sensor, e.g. water immersion sensors and accelerometers and circuitry to detect intrusion an to communicate the location of the intrusion to a computer control station . . . . The embodiment also facilitates deploying and retrieving the harbor fence system".

The prior art drilling robots are very expensive and quite large, while for preventing underground intrusion along long borders a large number of cheap robots is needed. Going underground is absolutely different from going subsurface in a water environment. Thus, it is an object of the present invention to overcome some of the drawbacks of the prior art, and to address underground intrusion detection in a novel and economic way.

BRIEF DESCRIPTION OF THE INVENTION

It is provided an alarm system for underground boundary intrusion detection, which may be deployed either in a robotically deployed method or in a conventional way, preferably underneath an above-ground fence or a wall. The robotically deployed method includes the steps of:

a) Constructing a computing-and-empowering apparatus.
b) Connecting thereof a longitudinally extended power-and-communication cable.
c) Connecting to the power-and-communication cable addressable junction-units, whereas each addressable junction unit includes a communication-controller and a sensor.
d) Storing a physical location and an address of each junction-unit in the computing-and-empowering apparatus.
e) Connecting each addressable junction-unit to a wired-mole. The wired-mole includes a wire bundle which initially is contracted there within. The wired mole has physical characteristics measurable by the sensor of the junction unit connected thereof.
f) Infiltrating the wired-moles normally into ground.
g) Directing the computing-and-empowering apparatus to command the wired moles to start digging operation and accordingly release the wire bundle, and to continue the digging operation until a predetermined wire bundle length has been released.
h) Once the majority of the wired-moles have finished digging, declaring that the alarm system is in an operational mode.

In the operational mode each of the sensors frequently measures the physical characteristics of the wired-mole connected thereof, and delivers the measurement of the physical characteristics to the computing-and-empowering apparatus. The computing-and-empowering apparatus stores and analyzes the measurements, comparing past and present measurements. Once it concludes that an underground boundary intrusion might occur, it issues an alarm signal which includes the physical location of the addressable junction units where intrusion presumably has occurred.

The wired mole includes a robotic mole and a wire bundle. The robotic mole includes a wire-release mechanism, a communicator, a rotary-motor, a drilling-head, and a navigation mechanism. The wire bundle includes at least two electrical power and communication wires, and has a first terminal and a second terminal. The first terminal is connected to the robotic mole, and the second terminal is used to for bi-directional communications to and from the robotic mole and to get power for the robotic mole.

In operation, the robotic mole gets an order to dig, the rotary-motor rotates the drilling-head, and the robotic-mole propagates in an underground route at a certain propagation rate due to a combined operation of drilling by the drilling head and navigation by the navigation mechanism, and the wire-release mechanism releases the wire-bundle in accordance with the propagation of the robotic-mole.

In a preferred embodiment, the navigation mechanism includes a steering device, an inclination meter, a 'processing and control unit' and a powering unit. In operation, the inclination meter measures the tilt of an internal axis of the robotic-mole relative to an upright axis and relative to a south-north axis, the wire-release mechanism measures the released length of the wire-bundle, the 'processing and control unit' gets the tilt information and the released length data, calculates desired underground route corrections and issues the corrections to the steering device and to the rotary-motor.

In another preferred embodiment, the robotic mole is a sandy robotic mole which includes a spiral screw shaped head, and a steering tail mechanism. The steering tail mechanism includes a stabilizing flipper and steering flats.

In yet another embodiment, the robotic-mole is a rocky robotic-mole which includes a drill shaped head and a pushing forward mechanism having hind mechanical legs. The drill shaped head is used to drill into the rock and push debris to rear. The hind mechanical legs may be extended, contracted and move laterally in a controllable manner.

In a preferred embodiment the computing-and-empowering apparatus comprises a power supply, a deployment-command module, an alarm-analysis module, an external interface, and a data-base module. The data-base module comprises a measurement table and a physical location table. The computing-and-empowering apparatus is controlled by a human operator through the external interface.

In another embodiment of the alarm system, it is deployed in a conventional manner, using a drilling machine to dig deep small bore diameter holes, into which simple wired-terminators are being inserted.

Based on an illegal tunneling activity in Gaza strip border in the years 2002-2006, the minimal width of such a tunnel is 50 cm and the maximum depth is 20 meter. These figures may effect the predetermined wire bundle length and the longitudinal density of wired-moles or wired terminators. Nevertheless, the invention provides for a wide range of dimensions, and fits a variety of needs and circumstances.

BRIEF DESCRIPTION OF THE DRAWINGS

The subject matter regarded as the invention is particularly pointed out and distinctly claimed in the concluding portion of the specification. The invention, however, both as to system organization and method of operation, together with features and advantages thereof, may best be understood by reference to the following detailed description when read with the accompanied drawings in which:

DETAILED DESCRIPTION OF THE INVENTION

Figure 1A:
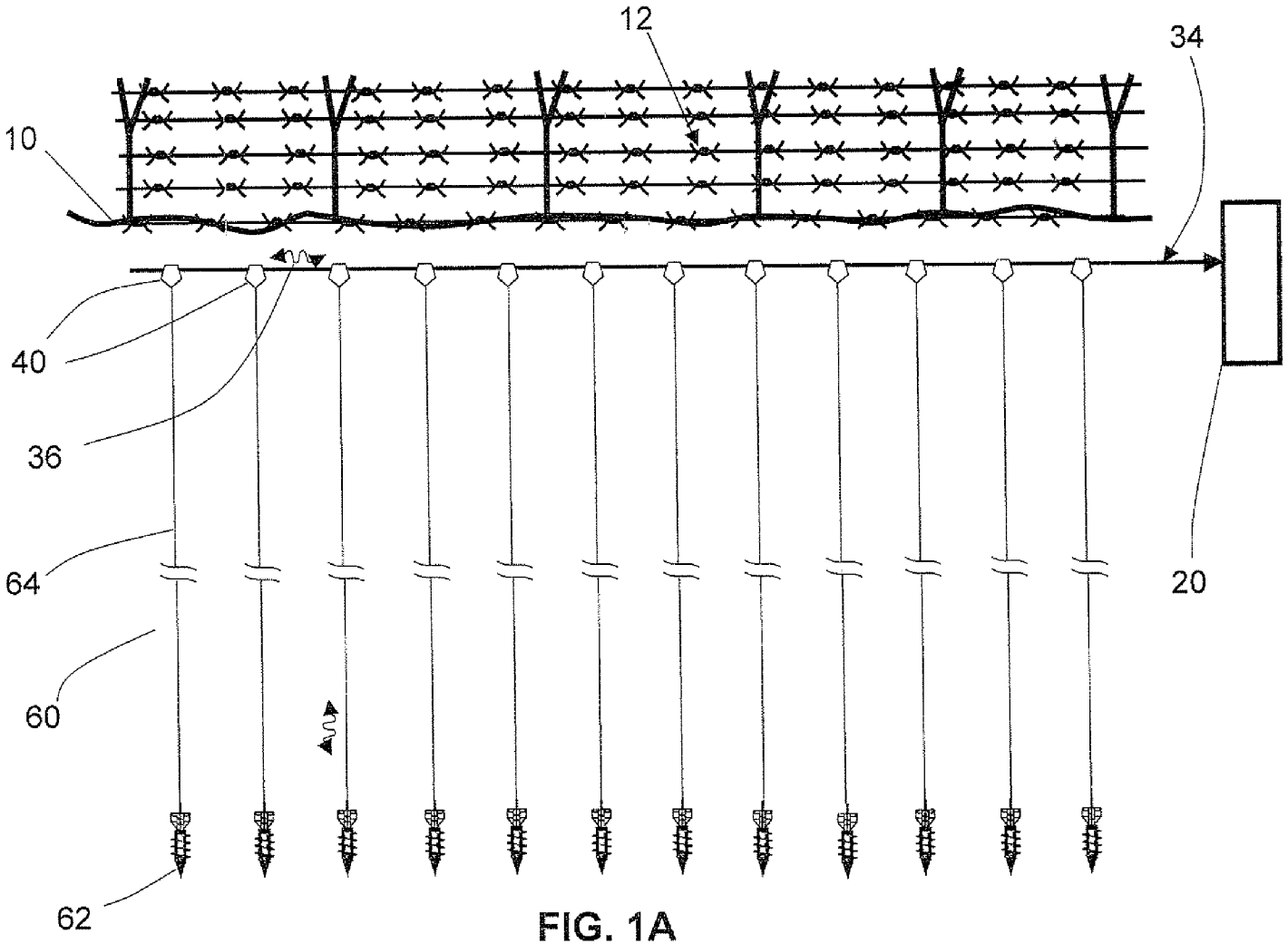
FIG. 1A depicts a robotically deployed underground alarm system.

Before explaining several embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. It should also be understood that throughout this disclosure, where a method is shown or described, the steps of the method may be performed in any order or simultaneously, unless it is clear from the context that one step depends on another being performed first.

Unless otherwise defined, all technical and scientific terms used herein have the same meaning as commonly understood by one of ordinary skill in the art to which this invention belongs. The systems, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

Figure 1B:
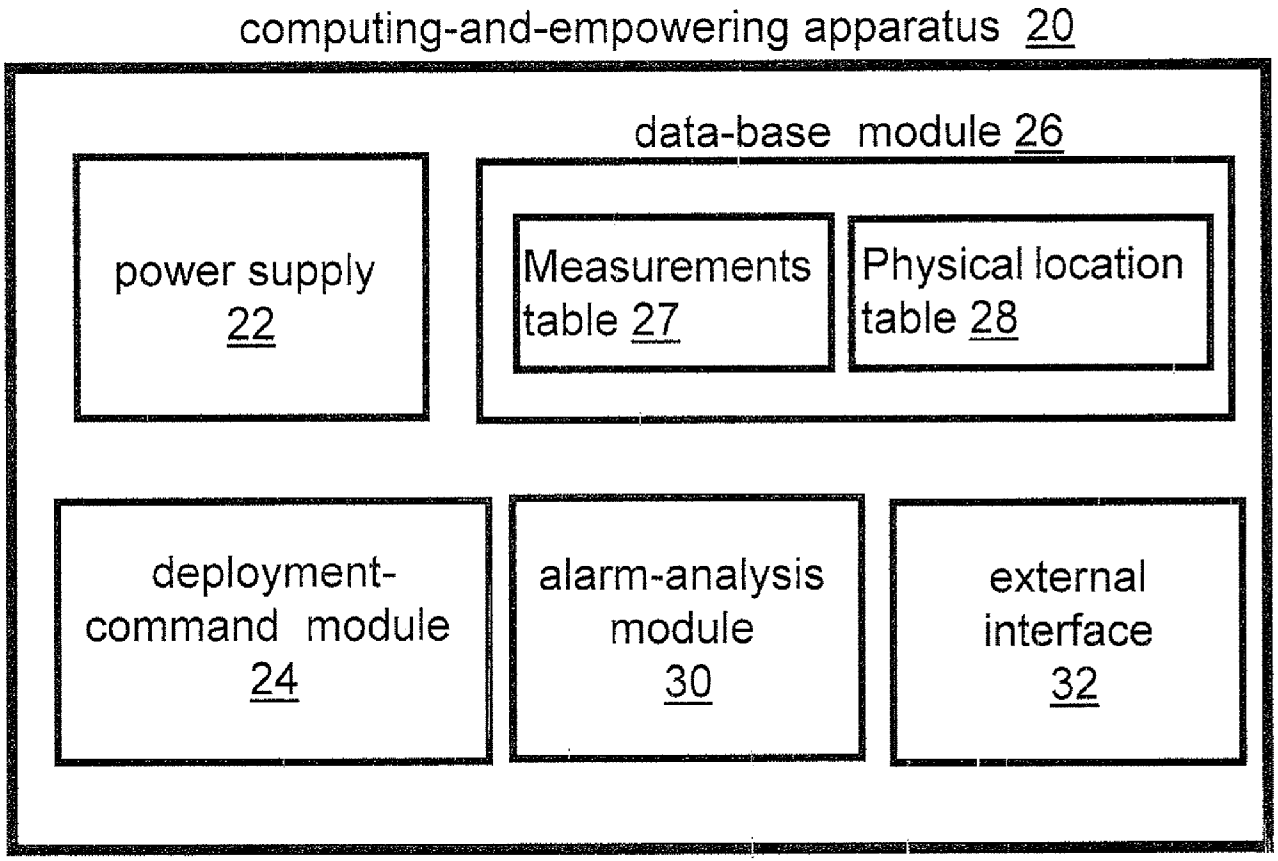
FIG. 1B represents a block diagram of a computing-and-empowering apparatus.

A first embodiment of the alarm system of the invention is outlined as follows: first, the structure of a robotically deployed alarm system is described, then its operational mode is outlined, and finally its deployment is delineated. FIG. 1A presents the underground alarm system, which is constructed under a ground surface 10, preferably substantially underneath an above-ground fence 12. The alarm system includes:

(a) A computing-and-empowering apparatus 20, depicted in the detailed block diagram of FIG. 1B. It includes a power supply 22, a deployment-command module 24, a data-base module 26, an alarm-analysis module 30, and an external interface 32. The data-base module 26 includes an measurement table 27 and a physical location table 28.

(b) A longitudinally extended power-and-communication cable 34 which includes pairs of electrical wires. The cable is a carrier of communication channel 36.

Figure 1C:
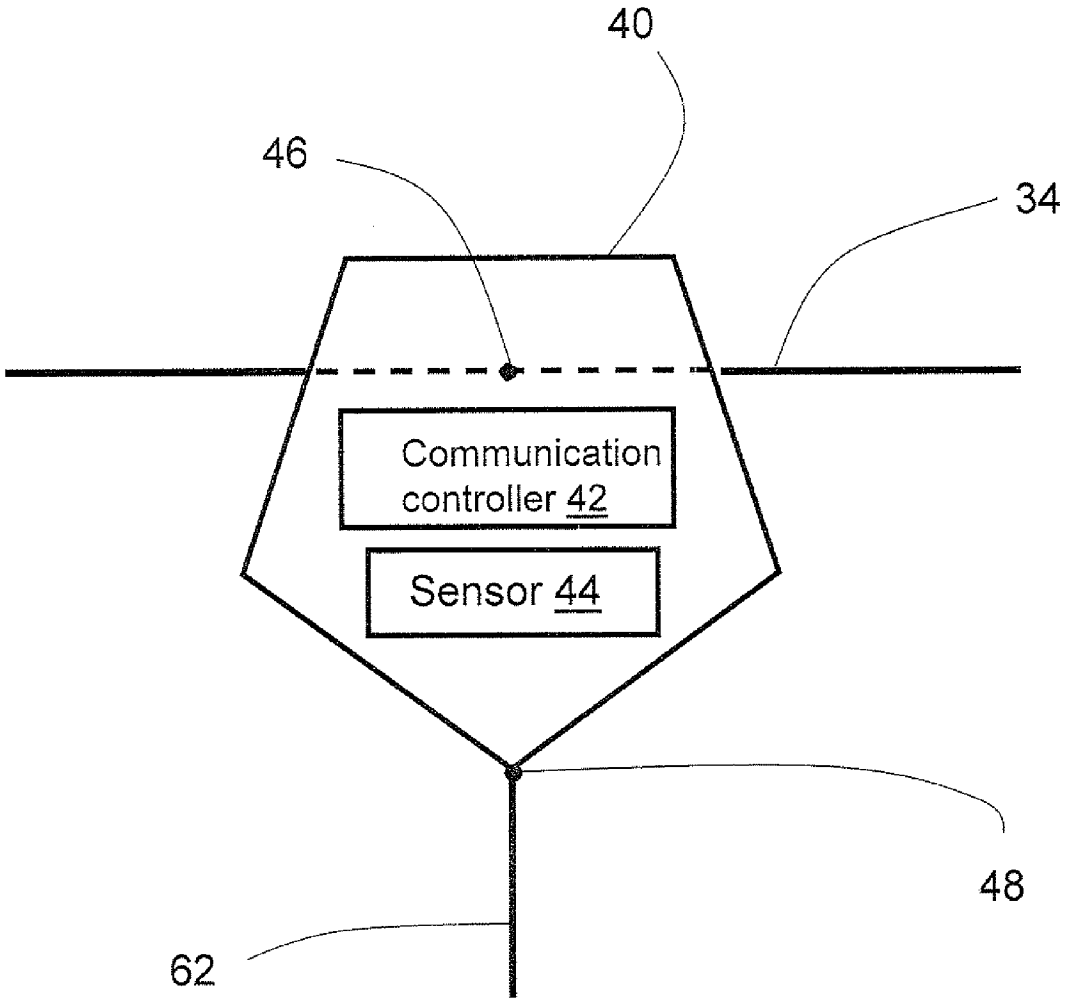
FIG. 1C shows a block diagram of an addressable junction unit.

(c) A first number of addressable junction units 40. Each unit includes a communication controller 42 and a sensor 44, and has a port 46 and a port 48, as shown schematically in FIG. 1C.

(d) A first number of wired-moles 60, whereas each of the wired-moles 60 includes a robotic mole 62 and a wire bundle 64. The wire bundle 64 includes electrical power wires, and has two terminals.

A detailed description of the robotic-mole appears below, before delineation of a deployment method of the alarm system.

The computing-and-empowering apparatus 20 is operated by a human operator through an external interface 32, either directly, or through a higher level automatic system. The power-and-communication cable 34 is connected to the computing-and-empowering apparatus 20. The addressable junction units 40 are connected to the power-and-communication cable 34 through the port 46. The wired-mole 60 is connected to the junction unit 40 through the port 48.

The physical location table 28 includes the address of each junction unit 40 together with a respective indication of its physical location. The wired-mole 60 has physical characteristics measurable by the sensor 44 of the junction unit 40 connected thereof.

In operation, each of the sensors 44 frequently measures the physical characteristics of the wired-mole 60 connected thereof. Consequently, the respective addressable junction unit 40 delivers, through the communication channel 36, the measured physical characteristics to the data-base module 26. The data-base module 26 stores the measurement together with an appropriate time record in the measurement table 27. Thus, the measurement table 27 includes recent and past measurements. The alarm-analysis module 30 frequently analyzes the measurement table 27, comparing the recent measurements with the past measurements. Once the alarm analysis module 30 concludes that an underground boundary intrusion might occur, it issues through the external interface 32 an alarm signal which includes the respective indication of the physical location of the junction unit 40, where intrusion have been suspected to occur.

Figure 1D:
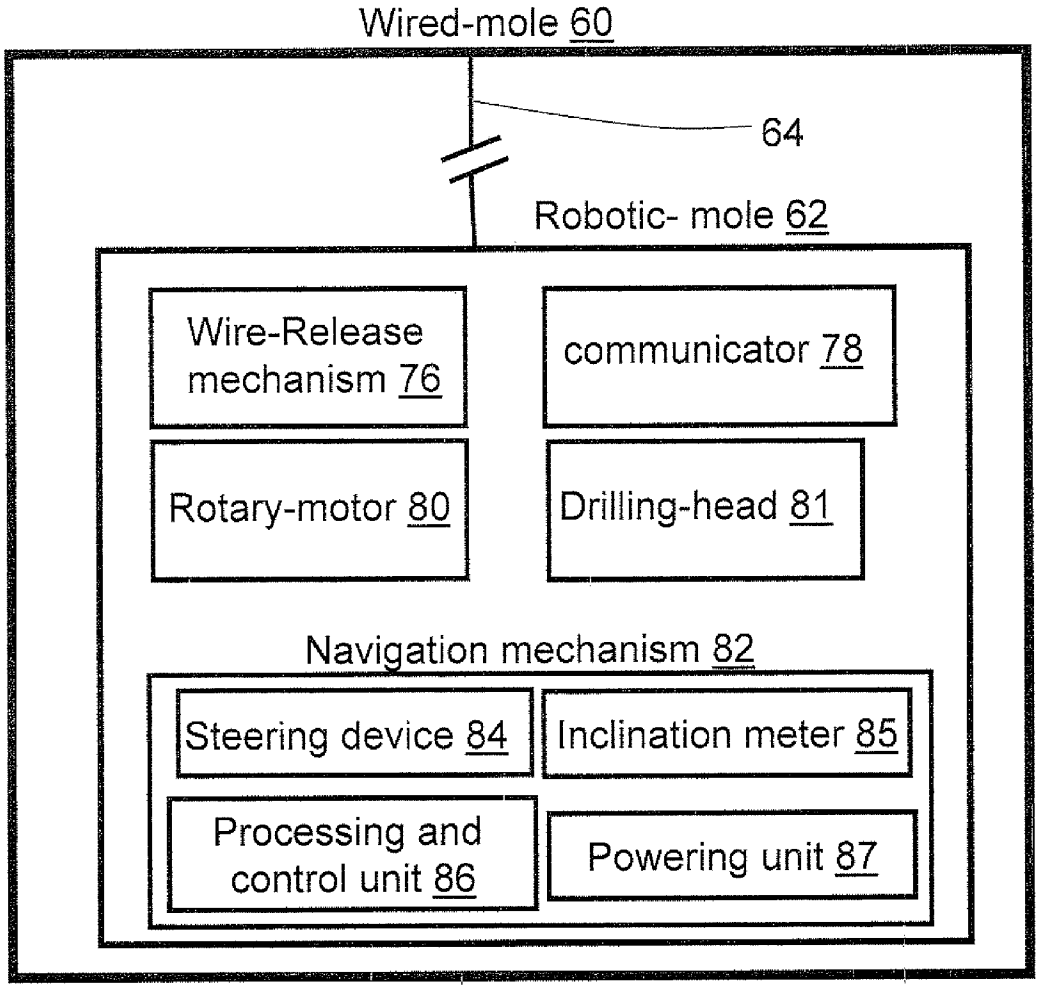
FIG. 1D is a block diagram of a wired-mole.

A block diagram of the wired-mole 60 appears in FIG. 1D, showing features needed for robotic deployment of the alarm system. The robotic-mole 62 includes a wire-release mechanism 76, a communicator 78, a rotary-motor 80, a drilling-head 81, and a navigation mechanism 82. The navigation mechanism 82 includes a steering device 84, an inclination meter 85, a processing and control unit 86, and a powering unit 87.

Figure 1E:
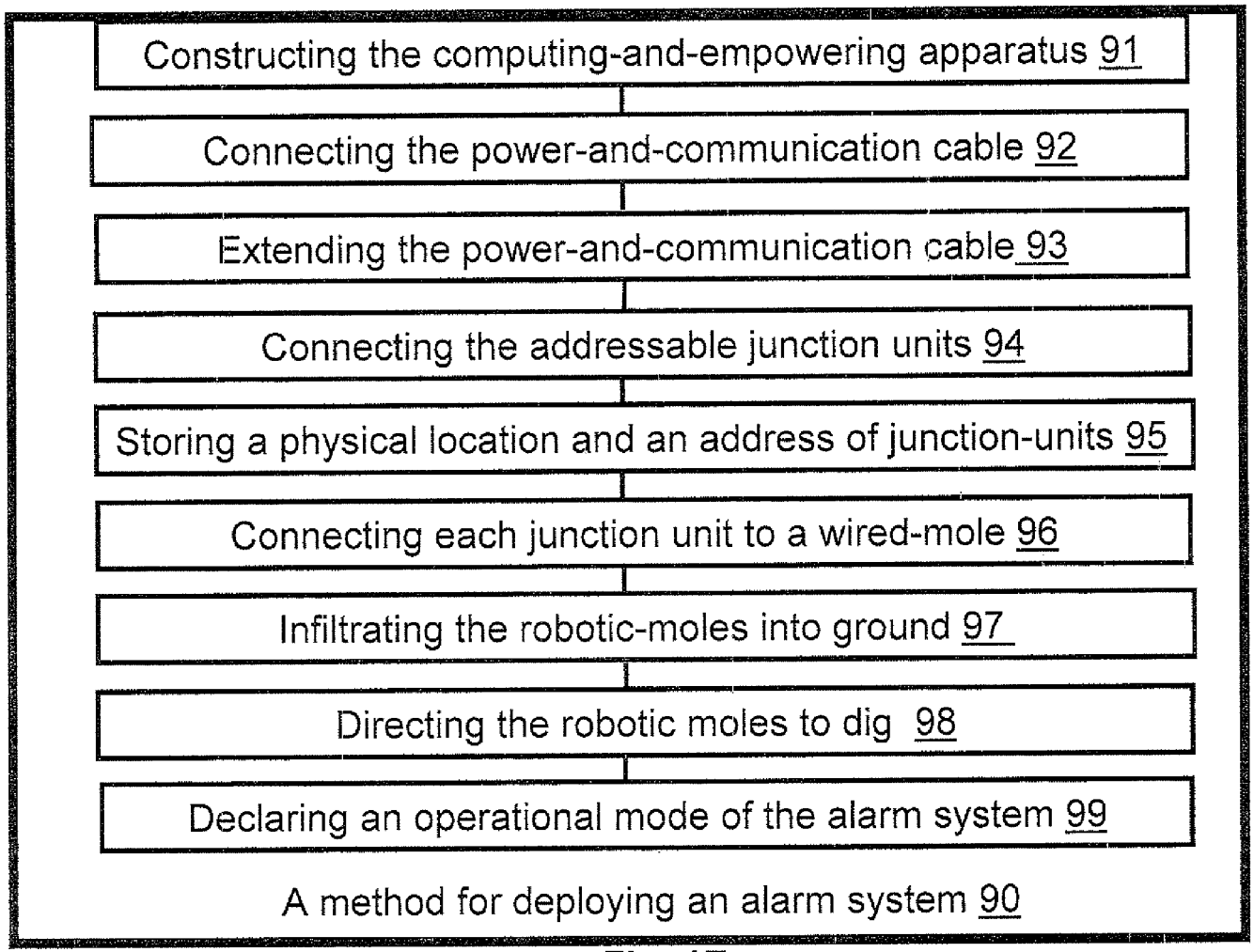
FIG. 1E is a flowchart of a method for deploying an alarm system.

A method 90 for deploying an alarm system is described in the flowchart of FIG. 1E. Method 90 includes the following steps:

(a) Constructing 91 the computing-and-empowering apparatus 20.

(b) Connecting 92 the power-and-communication cable 34 to the computing-and-empowering apparatus 20, and extending it 93 longitudinally, preferably inside relatively shallow ground groove.

(c) Connecting 94 the addressable junction units 40 to the power-and-communication cable 34.

(d) Storing 95 a physical location and an address of the first number of junction-units 40 in the physical location table 28.

(e) Connecting 96 each junction unit 40 to a wired-mole 60.

(f) Infiltrating 97 each of the robotic-moles 62 into ground in a certain direction which is substantially parallel for the majority of the robotic-moles 62.

(g) Directing 98 the deployment-command module 24 to command the robotic moles 62, through communication-controllers 42, to start digging operation, and continue digging operation until the deployment-command module 24 issues an interruption command. It issues an interruption command either due to a release of a predetermined length of a wire bundle 64, or due to an operator decision.

(h) Once the majority of the robotic-moles 62 have been stopped digging upon release of a predetermined wire bundle length, declaring 99 an operational mode of the alarm system, in which it operates as described above.

In one embodiment, the wire bundle 64 is an entangled bundle of four sub-millimeter electric wires, two wires for power delivery and two wires for communication. The sensor 44 is a miniature multi-meter, which measures at least one of the attribute group consisting of resistivity, capacity and inductivity of the electric wire pairs. Digging a tunnel is a harsh task, which has a very high potential to damage the sub-millimeter electric wires of the bundle wires 64 upon hitting. The damage is expected to occur to such an extent that all the characteristics in the attribute group are affected ensuring intrusion detection. Alternatively, the sensor 44 measures all the characteristics of the attribute group, and then a hit of the bundle wire 64 that causes an abrupt change in at least one electrical characteristic is sufficient to invoke an appropriate alarm signal.

Preferably, the wire pairs have a measurable conductance per unit length between the wires, and thus upon being damaged the amount of resistivity reveals the length of bundle which is still connected. This enables calculation of the hit depth, which may be provided in the issued alarm signal, in addition to the physical location indication of the junction-unit 40.

Figure 2A:
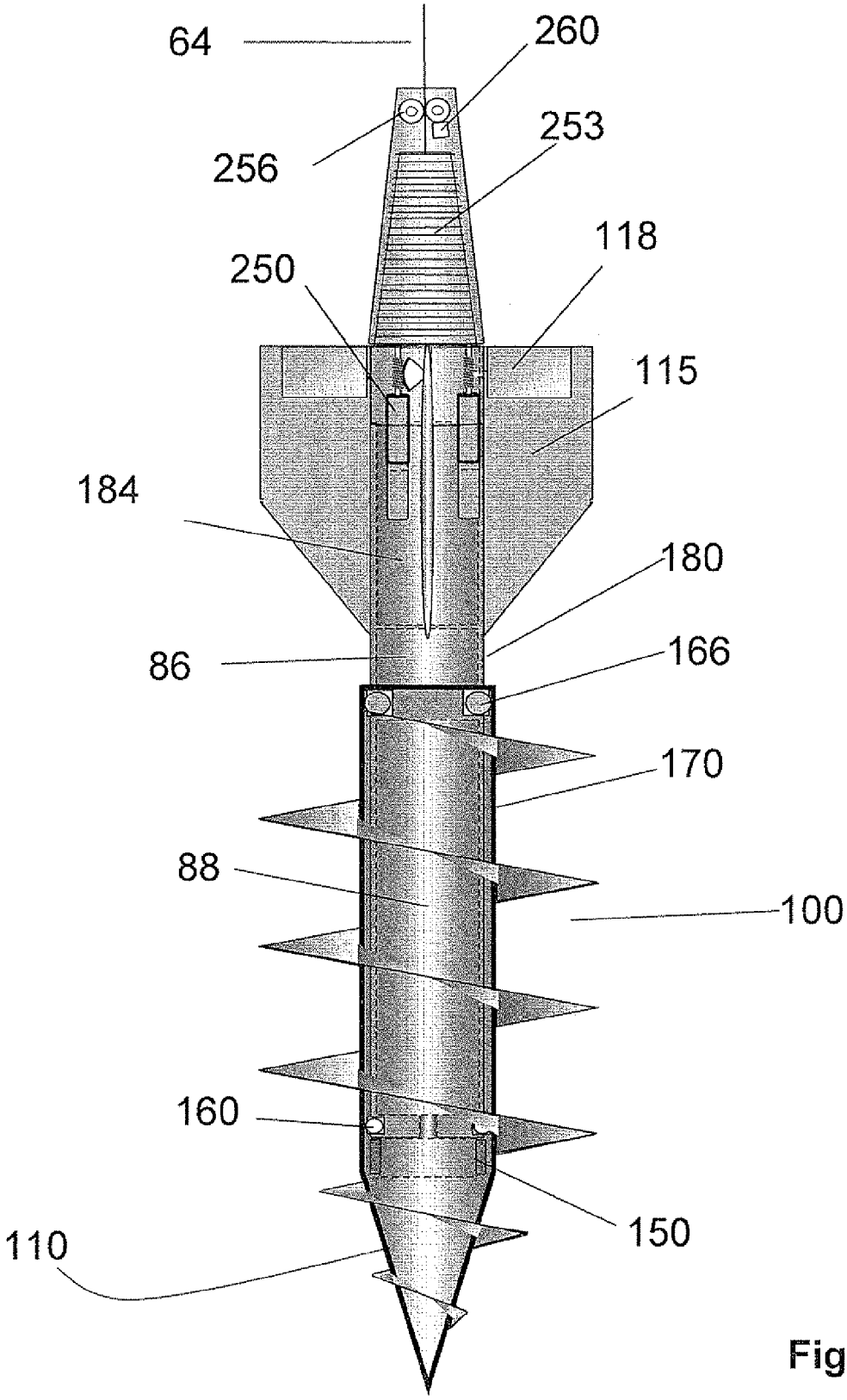
FIG. 2A illustrates a sandy robotic mole fitted for drilling in sand and sand stone.
Figure 2B:
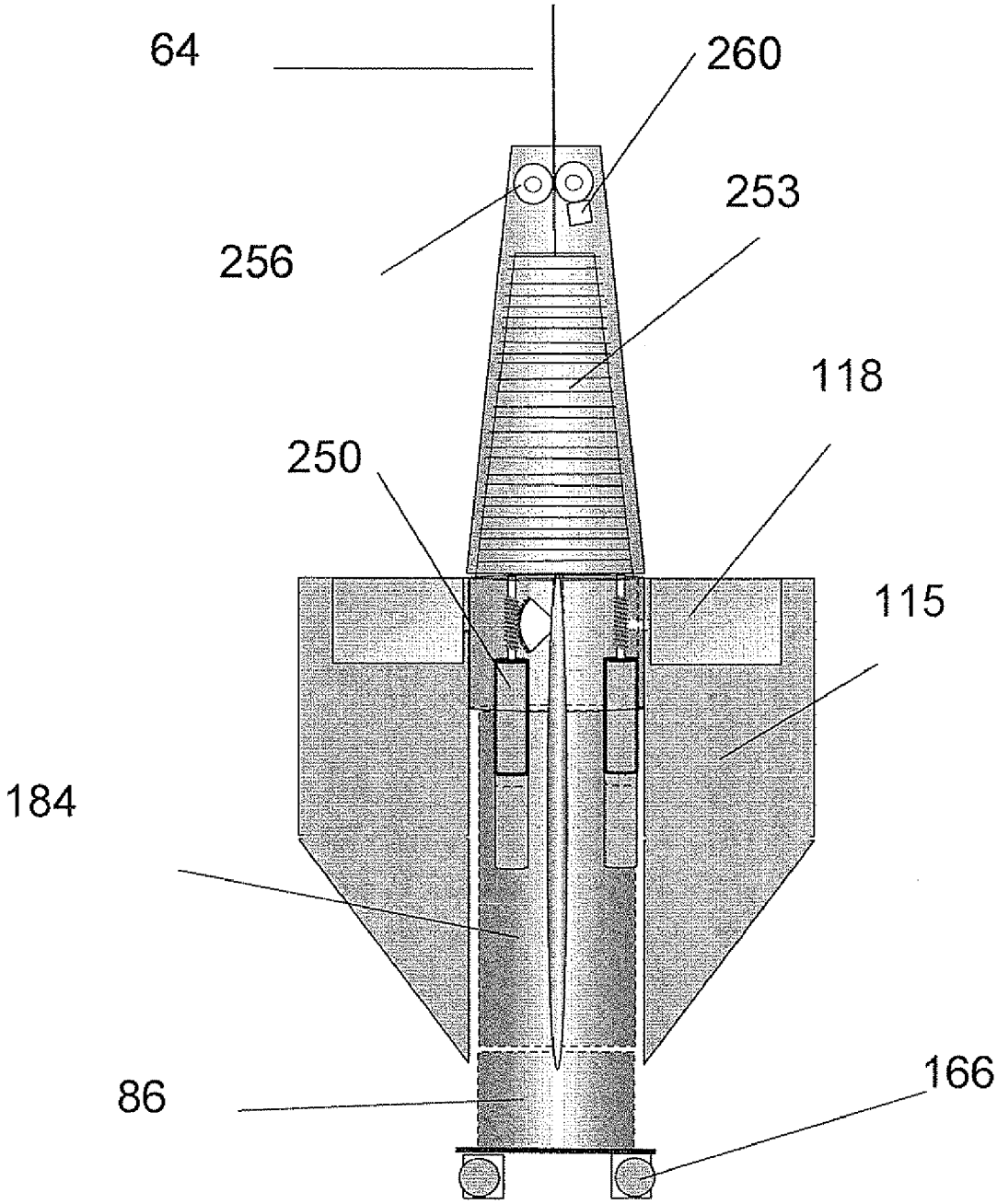
FIG. 2B is an enlarged view of the upper part of a sandy robotic mole.
Figure 3:
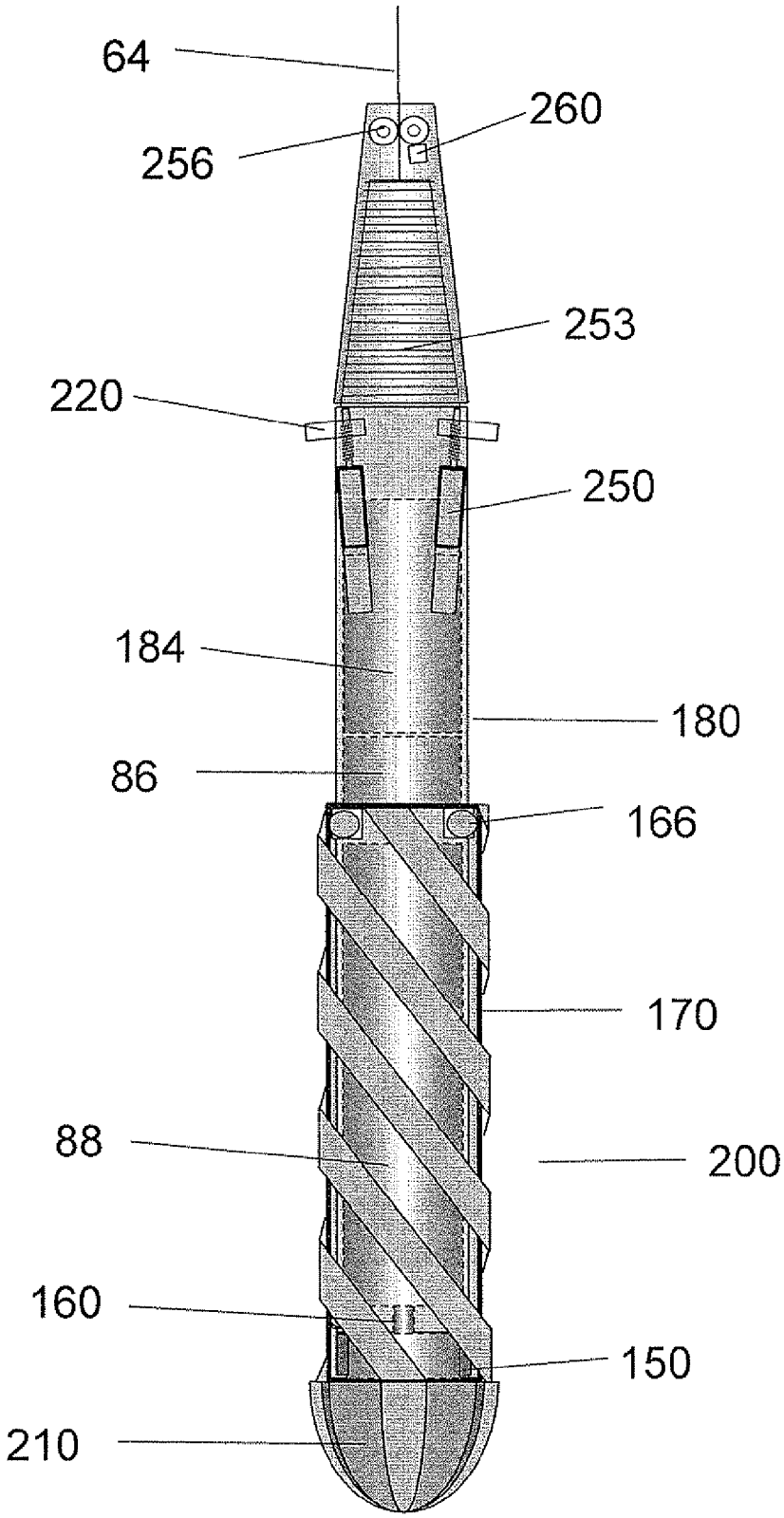
FIG. 3 illustrates a rocky robotic mole fitted for drilling in rocks.

Different embodiments of the robotic-mole construction are used in different ground conditions: a sandy robotic-mole 100, shown in FIG. 2A, and FIG. 2B, and a rocky robotic-mole 200, depicted in FIG. 3. The sandy robotic-mole 100 is designed for sandy ground, either loose or condensed sand stone. The drilling head is a spiral screw shaped head 110, used to push the robotic-mole 100 forward while moving sand to rear. The steering device of the sandy robotic mole is a tail mechanism similar to some extent to an airplane steering tail. The tail mechanism includes a stabilizing flipper 115 and steering flats 118.

The rocky robotic-mole 200 has a drill shaped head 210, used to drill into the rock and push debris to the rear. The rocky robotic-mole 200 has also a pushing forward mechanism, having hind mechanical legs 220, which may be extended, contracted and move laterally in a controllable manner. The pushing forward mechanism may function also as a steering device, using varying and, independent extension of each leg.

Preferably, the rotary motor 80 has an internal speed reduction transmission to achieve the high moment of rotation needed for drilling. Also, an external transmission 150, made of planetary gear head is preferably used as a means to engage the motor shaft and the drilling head. Due to the expected slow rotation of the drilling head, the digging duration might be quite long. Nevertheless, all the bundles are deployed simultaneously and thus the total deployment duration is as long as the digging duration of the slowest robotic moles and may be rather short. Therefore, a motor of relatively small power and a very high speed reduction may be used.

The robotic-mole 62 further includes a centering bearing 160, a pressure bearing 166, a revolving body 170, a still body 180 and a compartment 184. The compartment 184 stores the communicator 78, the 'processing and control unit' 86, and the powering unit 87. Both bearings, the centering bearing 160 and the pressure bearing 166, allow the rotation of the revolving body 170 around the still body 180. Due to the drag force on the tail of the still body 180, a pressure is exerted on the pressure bearing 166 which is constructed to hold this pressure accordingly. The centering bearing 160 allows for a smooth rotation by keeping the axes of the revolving body 170 and the still body 180 co-linear. The task of the processing and control unit 86, empowered by the powering unit 87, is to control and empower the steering device 84 and the rotary motor 80. The processing and control unit 86 gets tilt data from the inclination meter 85 and gets information and commands from the deployment command module 24 through the communicator 78. The steering flats 118 of the sandy robotic mole and the legs 220 of the rocky robotic mole are operated by a combination 250 of tiny motors and dedicated transmissions.

One embodiment of the wire-release mechanism 76 is shown in FIG. 2B. The majority of the wire-bundle 64 is initially in a contracted package 253, in which the wire-bundle is either being rolled as shown or being folded. The wire-bundle is stretched towards the junction unit 40, passing between a pair of pulleys 256, pulley revolutions being countable by an attached encoder 260.

While digging in, the robotic-mole 62 discharges the wire bundle 64. The length of the discharged wire-bundle is measured by the pulley encoder 260. In one embodiment, the inclination meter 85 includes an accurate bi-axial tilt meter and an accurate electronic compass, which measure the tilt of an internal axis of the robotic-mole relative to an upright axis and relative to a south-north axis.

The communicator 78 transfers the inclination meter measurements and the discharged wire-bundle length data, through the communication controller 42, to the deployment-command module 24. The deployment-command module 24 integrates the discharged length, taking the tilt angles into account, to get the robotic mole underground position. It sends this information to the processing and control unit 86 and also stores the wire underground route into the physical location table 28.

In one embodiment, the calculation of the robotic mole position is conducted in the processing and control unit 86. In this embodiment, the workload on the deployment-command module 24 is reduced on the expense of an excess workload on the processing and control unit 86. Thus, the robotic mole 62 might be more capable, and presumably more expensive.

As soon as the robotic-mole 62 penetrates into the requested length, the deployment-command module 24 issues an interruption command. The rotary motor 80 stops and then, a reference measurement of the electronic characteristics of the wired-mole 60 is taken by the sensor 44 and is stored in the measurement table 27. Any abrupt and severe change of the characteristics is interpreted by the alarm-analysis module 30 as a hit by a tunnel, unless it coincides with a similar change in many nearby wired-moles. In the case of such a coincidence, the alarm-analysis module 30 suspects an earthquake and issues, through the external interface 32, a request to check seismic signals. If all the junction units 40, starting at a certain location, stop responding, the alarm-analysis module 30 issues a damage-to-the-main-cable signal.

In yet another embodiment, the communication channel between the computing-and-empowering apparatus and each addressable junction-unit 40 is a wireless channel with appropriate transceivers at the computing-and-empowering apparatus and at the junction-units 40.

In other embodiment, the robotic mole has additional sensing means for elimination of false alarms, due to seismic signals for example.

Figure 4A:
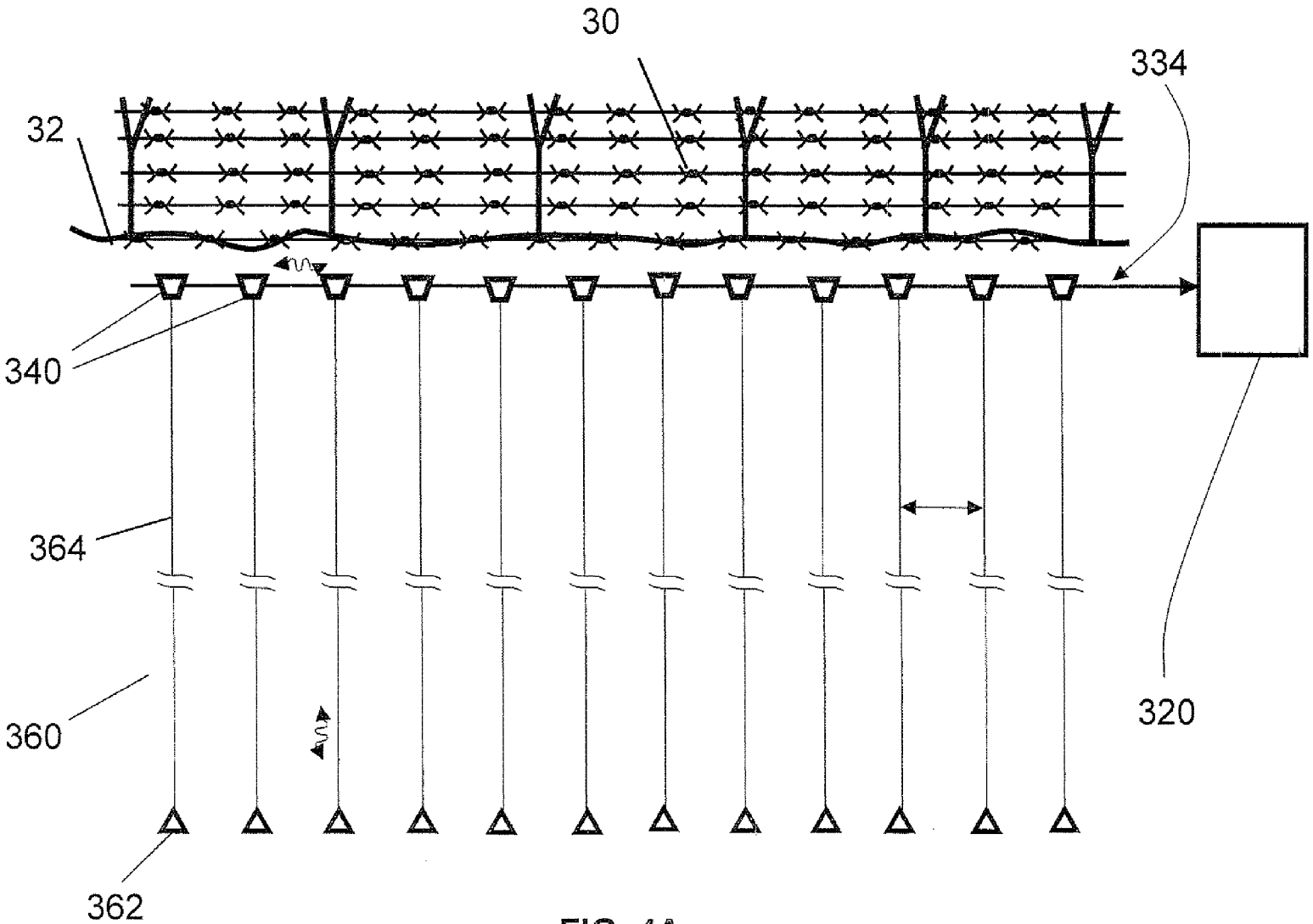
FIG. 4A depicts a conventionally deployed underground alarm system.
Figure 4C:
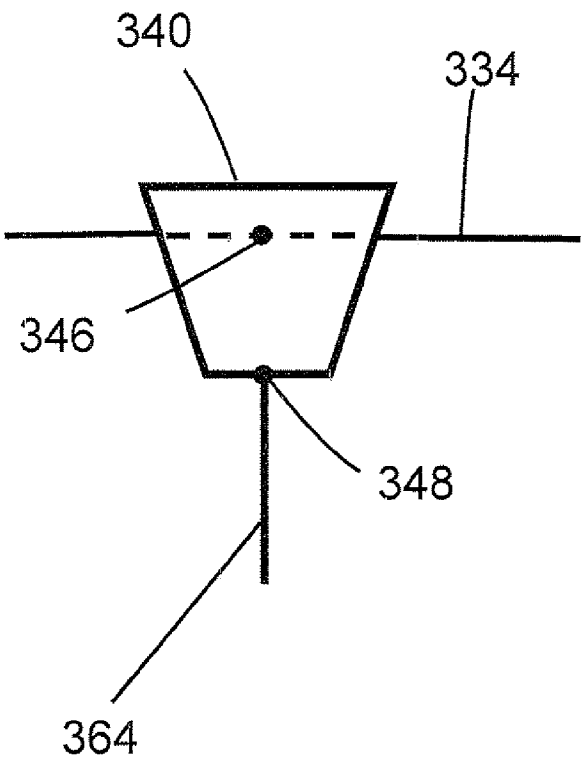
FIG. 4C shows an addressable sensor.
Figure 4B:
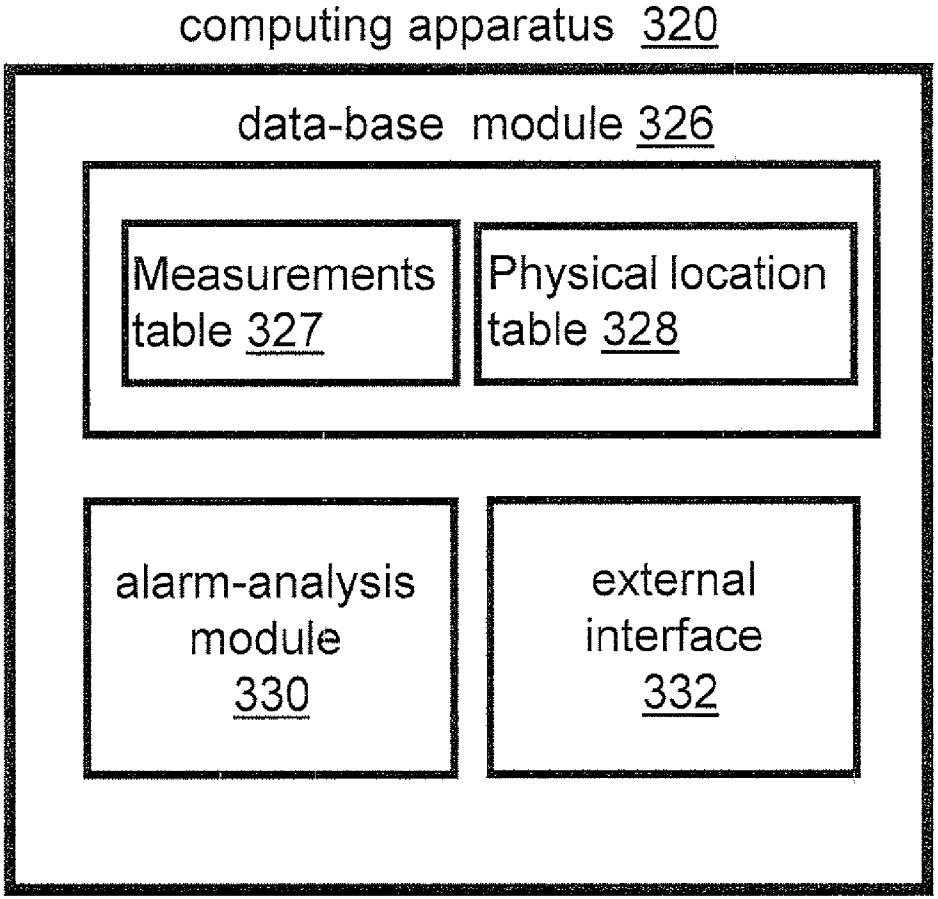
FIG. 4B illustrates a computing apparatus.

A second preferred embodiment of the present invention is a conventionally deployed alarm system, as presented in FIG. 4A, FIG. 4B, and FIG. 4C. In a conventional deployment, a drilling machine digs deep small-bore-diameter holes, into which a wired-terminator 360 is being inserted. The conventionally deployed alarm system includes:

a) A computing apparatus 320 including a data-base module 326, an alarm-analysis module 330, and an external interface 332.

b) A communication cable 334.

c) Addressable sensors 340, each having a port 346 and a port 348.

d) Wired-terminators 360, each including a terminator 362 and a wire bundle 364. The wire bundle 364 includes at least one wire and has two terminals, whereas one terminal is connected to the terminator 362.

The other terminal of the wired-bundle 364 is connected to an addressable sensor 340. The addressable sensor 340 is connected to the communication cable 334, which in turn is connected to the computing apparatus 320.

Each of the wired-terminator 360 has at least one physical characteristic measurable by the addressable sensor 340 connected thereof. The majority of the wire bundles 364 are, substantially mutually parallel.

In operation, each of the addressable sensors 340 frequently measures the physical characteristics of the wired-terminator 360 connected thereof, and delivers the measurement to the data-base module 326 which stores the measurement together with an appropriate time record in a measurement table 327. The measurement table 327 is thus composed of recent and past measurements conducted by the addressable sensors 340. The alarm-analysis module 330 frequently analyzes the measurement table 327, comparing the recent measurements with the past measurements. Once the alarm analysis module 330 concludes that an underground boundary intrusion is being occurred, it issues an alarm signal through external interface 332, which signal includes one or more addresses of the addressable sensors 340 where intrusion have been suspected to occur.

In one preferred embodiment, the wire bundle includes two entangled electric wires, and the terminator is a passive electrical component of predetermined resistivity, capacity, or inductivity, or a combination thereof. In yet another embodiment, the terminator is the wire bundle termination.

In another embodiment, the wired-terminator includes a terminated optic fiber sensor as taught for example in "Fiber Optic Sensors" F. T. S. Yu and S. Yin eds. Marcel Dekkers, NY, 2002.

In one embodiment, the ports 346 and the port 348 are functionally identical. In another embodiment they are functionally distinct.

In yet another embodiment of the conventionally deployed alarm system, a passive junction replaces the addressable sensor 340, the wired-terminators 360 are addressable, and the computing apparatus 320 directly communicates with the wired-terminators 360, whereas communication interruption indicates tunnel intrusion.

In other embodiment, the wired terminator 360 has sensing means for elimination of false alarms, due to seismic signals for example.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way by the examples described.

The invention claimed is:

1. A method for deploying an alarm system characterized by being fitted for deploying an alarm system for underground boundary intrusion detection, the method comprising:

a) constructing a computing-and-empowering apparatus;

b) connecting thereof at least one longitudinally extended power-and-communication cable;

c) connecting to the power-and-communication cable a first number of addressable junction-units, whereas each addressable junction unit comprises a communication-controller and a sensor;

d) storing a physical location and an address of each junction-unit in said computing-and-empowering apparatus;

e) connecting each addressable junction-unit to one of a first number of wired-moles, said wired-mole includes a wire bundle which initially is contracted there within, whereas the wired mole has at least one physical characteristic measurable by said sensor of the junction unit connected thereof;

f) infiltrating the wired-moles into ground in a certain direction which is substantially parallel for the majority of the wired-moles;

g) directing said computing-and-empowering apparatus to command the wired moles to each start digging operation and accordingly release its wire bundle, and to continue said digging operation until a predetermined wire bundle length has been released by the wired-mole; and h) once the majority of the wired-moles have stopped digging upon release of the corresponding predetermined wire bundle length, declaring an operational mode of an alarm system, said alarm system comprised of said computing-and-empowering apparatus, said at least one longitudinally extended power-and-communication cable, said first number of addressable junction units, and at least the majority of said first number of wired-moles;

whereby in said operational mode each of said sensors frequently measures said at least one physical characteristic of a corresponding one of said wired-moles connected thereof, and delivers the measurement of the physical characteristics to said computing-and-empowering apparatus, which stores and analyzes the measurements, comparing past and present measurements, and once said computing-and-empowering apparatus concludes that an underground boundary intrusion might be occurring, it issues an alarm signal comprised of the physical location of the addressable junction units where intrusion presumably occurred.

2. The method of claim 1, wherein the wired-mole includes a robotic mole, whereas initially most of said wire bundle is contracted within said robotic mole.

3. The method of claim 2, wherein the computing-and-empowering apparatus comprises a power supply, a deployment-command module, an alarm-analysis module, an external interface, and a data-base module.

4. The method of claim 3, wherein said data-base module comprises a measurement table and a physical location table.

5. The method of claim 3, wherein said robotic-mole comprises a wire-release mechanism, a communicator, a rotary-motor, a drilling-head, and a navigation mechanism.

6. The method of claim 5, wherein said navigation mechanism includes a steering device, an inclination meter, a processing and control unit and a powering unit.

7. The method of claim 1, wherein said wire bundle comprises at least two electrical power wires.

8. The method of claim 5, wherein said wire-release mechanism measures the released length of said bundle-wire and communicates the released length to said deployment-command module in series through said communicator, said wire-bundle, said communication-controller, and through said power-and-communication cable.

9. The method of claim 2, wherein said robotic-mole is a sandy robotic-mole.

10. The method of claim 2, wherein said robotic-mole is a rocky robotic-mole.

11. The method of claim 1, wherein the alarm system is deployed underneath an above-ground fence or wall.

12. The method of claim 1, wherein said certain direction is substantially normal to ground.

13. The method of claim 3, wherein said computing-and-empowering apparatus is controlled by a human operator through said external interface.

14. The method of claim 7, wherein said sensor is a miniature multi-meter, which measures at least one of the attribute group consisting of resistivity, capacity and inductivity of the electric wire pair.

15. The method of claim 7, wherein said sensor is a miniature multi-meter, which measures all of the attribute group consisting of resistivity, capacity and inductivity of the electric wire pair.

16. The method of claim 7, wherein said sensor measures the inductivity of the electric wire pair, and is able to measure a remained length of the electric wire pair in case that it have been cut as a result of underground intrusion.

17. The method of claim 1, wherein said computing-and-empowering apparatus and the addressable junction-unit are each equipped with a transceiver and a wireless channel is established between said computing-and-empowering apparatus and each addressable junction-units.

18. The method of claim 1, wherein said power-and-communication cable comprises at least one pair of electrical wires.

19. The method of claim 1, wherein power-and-communication cable carries at least one communication channel.

20. The method of claim 1, wherein said wire bundle is an entangled bundle of four sub-millimeter electric wires, two wires for power delivery and two wires for communication.

* * * * *